US006793000B2

(12) United States Patent
Fink

(10) Patent No.: US 6,793,000 B2
(45) Date of Patent: Sep. 21, 2004

(54) HOT CHAMBER PRESSURIZED CASTING MACHINE AND PROCESS FOR OPERATING SAME AND MAKING CAST PARTS THEREWITH

(75) Inventor: Roland Fink, Winterbach (DE)

(73) Assignee: Oskar Frech GmbH & Co., Schorndorf (DE)

( * ) Notice: Subject to any disclaimer, the term of this patent is extended or adjusted under 35 U.S.C. 154(b) by 0 days.

(21) Appl. No.: 09/984,128

(22) Filed: Oct. 29, 2001

(65) Prior Publication Data

US 2002/0050331 A1 May 2, 2002

(30) Foreign Application Priority Data

Oct. 27, 2000 (EP) ..... 00123326

(51) Int. Cl.[7] ..... B22D 17/04; B22D 17/32; B22D 27/02

(52) U.S. Cl. ..... 164/113; 164/316; 164/48; 164/250.1

(58) Field of Search ..... 164/71.1, 250.1, 164/48, 501, 511, 113, 312, 316

(56) References Cited

U.S. PATENT DOCUMENTS 4,743,190 A 5/1988 Brunnschweiler ..... 425/149
5,482,101 A * 1/1996 Fink ..... 164/312
5,560,419 A * 10/1996 Yoshida et al. ..... 164/4.1
5,699,849 A * 12/1997 Fink ..... 164/155.4

FOREIGN PATENT DOCUMENTS

DE 2922914 12/1980 ..... B22D/17/32
JP 60-250866 * 12/1985 ..... B22D/17/20

OTHER PUBLICATIONS

Copy of the Search Report.

* cited by examiner

*Primary Examiner*—Kiley Stoner
*Assistant Examiner*—Kevin P. Kerns
(74) *Attorney, Agent, or Firm*—Crowell & Moring LLP

(57) ABSTRACT

A method of operating a hot-chamber diecasting machine is provided in which, after the filling of the mold, a compressional vibration is generated which prevents the molten metal from rapidly solidifying at least in the narrowest cross-section of the feed orifice between the ascending bore and the mouthpiece and the mold. In this manner, it becomes possible to increase the afterpressure upon the molten metal in the mold in comparison to conventional hot-chamber diecasting processes in order to achieve cast parts of a higher quality.

36 Claims, 4 Drawing Sheets

HOT CHAMBER PRESSURIZED CASTING MACHINE AND PROCESS FOR OPERATING SAME AND MAKING CAST PARTS THEREWITH

BACKGROUND AND SUMMARY OF THE INVENTION

This application claims the priority of 001 23 326.1, filed in Germany, and corresponding application filed in the European Patent Office under European Application No. EP00123326.1, filed in Europe on Oct. 27, 2000, the disclosure of which is expressly incorporated by reference herein.

The invention relates to a method of operating a hot-chamber diecasting machine by which molten metal is pressed from the casting vessel by way of an ascending bore, a mouthpiece and a feed orifice into a mold. The invention also relates to a hot-chamber diecasting machine by means of which this method can be implemented.

In the case of the hot-chamber method, the liquid metal is delivered by way of a casting vessel and a casting plunger into a mold. The casting vessel and the casting plunger are, in this case, constantly situated in the metal bath. During the movement of the plunger and also at the end of the plunger movement, depending on the temperature of the molten metal, losses occur between the plunger rings and the casting vessel bore. Therefore, in the case of the hot-chamber method, when casting zinc, which has a metal bath temperature of approximately 420° C., approximately 300 bar of metal pressure can be generated at the end of the filling operation. When pressure casting magnesium, which has a metal bath temperature of approximately 650° C., only approximately 250 bar of metal pressure can be reached also at the end of the filling operation.

Cold-chamber diecasting methods (German Patent Document 29 22 914 C2) also exist by which the mold filling phases take place in a manner similar to that of the hot-chamber diecasting method. In the cold-chamber method, in which the casting vessel and the casting plunger are not situated in the liquid molten metal, it is possible to generate higher end pressures of a magnitude of from 400 bar to 700 bar. This means that, because of the high metal pressure of the cold-chamber method, it is possible to produce parts of a higher density. This means, in turn, that there is less porosity in the diecast part, as well as a high stability, higher elongation values and a higher surface density.

In the case of the hot-chamber diecasting method, the filling operation of the mold takes place approximately in 7 ms to 20 ms (milliseconds). As mentioned above, the maximal casting pressure is built up at the end of the filling operation. By way of the feed orifice, this casting pressure acts upon the metal already situated in the mold cavity. Since the thickness of the feed orifice is a function of the wall thickness and of the surface quality of the parts as well as of the finishing, and the thinnest wall thickness of the feed orifice is the thickness of the gate, the molten metal will first solidify at this point. As a result, the feed orifice is closed off from the mold cavity, and the afterpressure applied from the direction of the casting plunger can no longer be effective or can no longer be fully effective. For the purpose of an explanation, it is pointed out that the thinnest wall thickness of a gate, for example, in the case of a zinc part, is in the range of 0.3 to 0.6 mm and, in the case of a magnesium part, is in the range of 0.4 to 0.8 mm. As a result of the cooling occurring in this area, the material solidifies relatively fast at this point.

It is an object of the present invention to provide, in the case of a method of the initially mentioned type that, despite the lower end pressures of the hot-chamber casting method, diecast parts can be achieved which have similar characteristics as those produced by the cold-chamber method.

For achieving this object, it is suggested in the case of a method of the initially mentioned type that, at the end of the mold filling operation, a compressional vibration, which prevents the molten metal from rapidly solidifying, is generated at least in the narrowest cross-section of the feed orifice. By varying the pressure, a movement is achieved in the molten metal which has the result that the previously mentioned gate cross-section with its thin wall thickness will not solidify so fast and thus does not "freeze". In this manner, the pressure can act into the mold for a longer time and can therefore also counteract the volume-caused shrinking of the molten metal.

As a further development of preferred embodiments of the invention, the pressure can be increased after a certain time period by way of a time function element, in which case the pulsation is maintained so that, when the molten metal has reached the so-called semisolid phase, the highest densification will occur. In this phase, no more burr will occur on the outer contours of the diecast part. As a result of the vibrations, which can be introduced at a relatively high frequency, the pressure is fully transmitted to the metal situated in the mold. This will result in a sort of hammering upon the filled mold which leads to a final densification of the material.

As a further development of certain preferred embodiments of the invention, in the case of a method in which a casting plunger is present which is moved by way of an electric-motor-operated drive, the pulsating pressure can be generated by superimposing a vibration upon the drive. As a further development of certain preferred embodiments of the invention, this vibration may amount to approximately 300 Hz and can be introduced at a defined deceleration of the casting plunger velocity. The casting plunger velocity can be determined in the known manner as a function of the path so that it will not be problematic to determine the point in time at which the pulsating pressure becomes necessary.

As a further development of certain preferred embodiments of the invention, the pressure can be decreased or increased in a pulsating manner compared with the maximal casting pressure, in which case, as previously indicated, the pressure in the end phase is decreased during a first short time period and is increased during a second time period before the complete solidification of the molten metal occurs.

The invention also relates to a hot-chamber diecasting machine by means of which the new method can be implemented. This hot-chamber diecasting machine has a casting plunger drive and a control device therefor. A pulsation device, which can be connected in the end phase of the filling operation and whose vibrations act upon the drive shaft of the casting plunger, is assigned to the casting plunger drive. If the casting plunger drive is equipped with a casting plunger driven by an electric motor, the pulsation device may consist of an electric servo drive and of a control device acting upon the latter. This control device may be an electronic computer which is operated as correspondingly designed software. The servo drive itself may be a brushless electric motor with a low flywheel effect. Such a drive largely avoids the effect of moments of inertia upon the casting plunger which, however, in a known manner, can also be reduced by means of an elastic element between the driving motor and the casting plunger or by a controlled limiting of the servo drive.

Other objects, advantages and novel features of the present invention will become apparent from the following detailed description of the invention when considered in conjunction with the accompanying drawings.

DETAILED DESCRIPTION OF THE DRAWINGS

Figure 1:
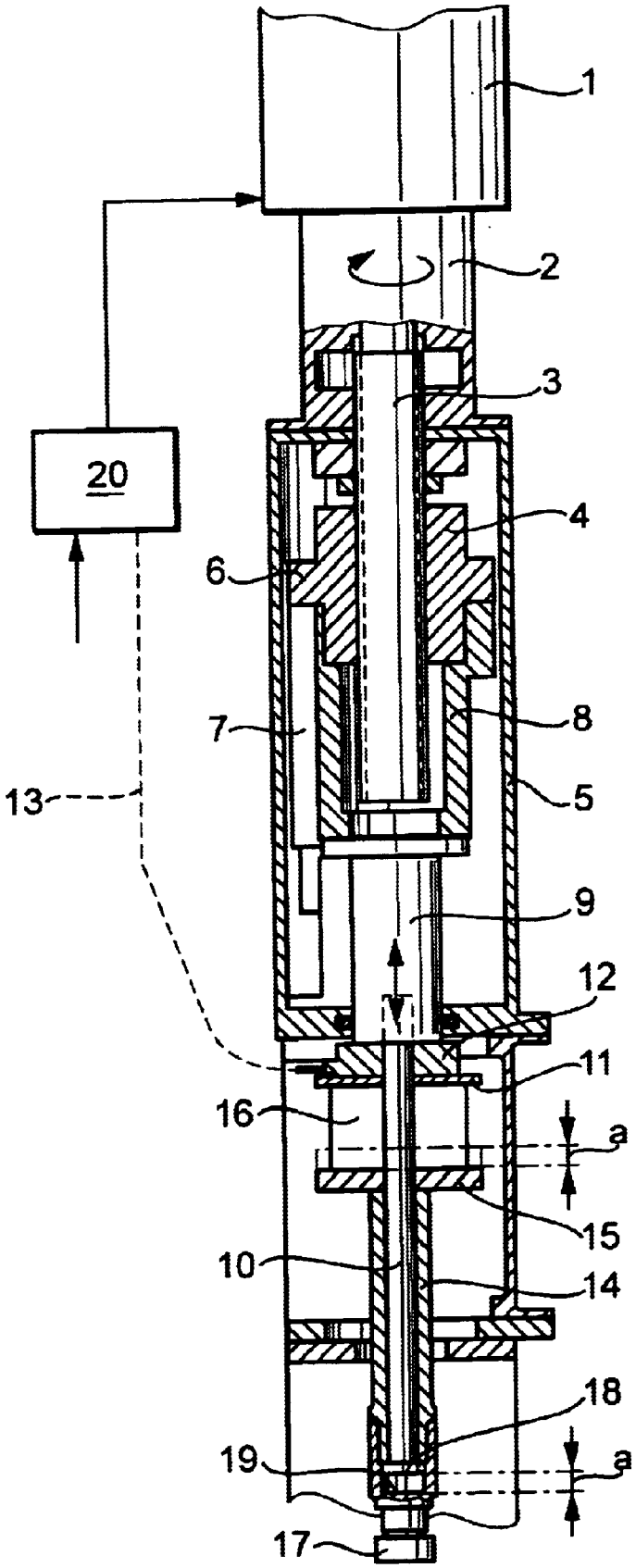
FIG. 1 is a schematic representation of a casting plunger drive with an electric motor and a control device for generating a vibration, conducted according to preferred embodiments of the present invention.

FIG. 1 illustrates the pressing-in unit of a hot-chamber diecasting machine for processing molten metal which, in addition, is equipped in a known manner with a casting vessel arranged in the metal bath, with a casting plunger which can be moved in the casting vessel by way of the pressing-in unit and with an ascending bore and a mouthpiece arranged at its ends. During the casting operation itself, the molten metal is to be fed, also by way of the mouthpiece to the mold by way of a feed orifice.

Figure 1A:
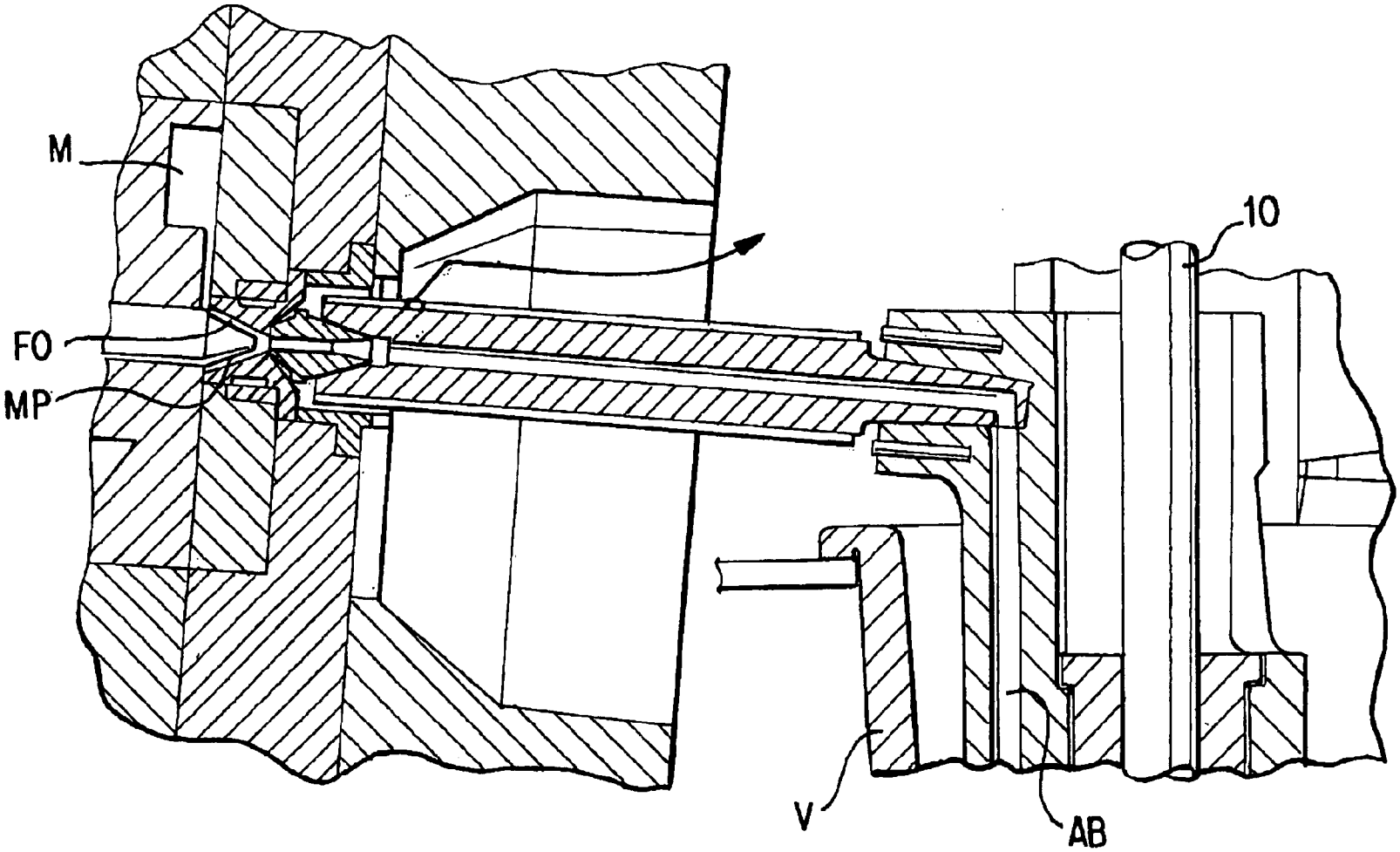
FIG. 1A schematically depicts the casting arrangement with which the FIG. 1 unit is utilized.

FIG. 1A schematically depicts a casting vessel V with an extending bore AB and a mouthpiece MP opening by way of a feed orifice FO to a mold M.

In the case of the pressing-in unit according to FIG. 1, an electric motor 1, for example, an asynchronous motor or another variant of a servo motor is provided with a transmission, which is not shown in detail, and with a coupling part 2 which drives a threaded spindle 3 to carry out a rotating movement. The threaded spindle 3 is guided in a sealed-off manner in a protective housing 5. On the threaded spindle 3, a nut 4 is guided which interacts with the thread of the spindle 3 and engages by means of a guiding cam 6 in a groove 7 inside the housing 5 and thereby is non-rotatably guided in the housing 5. By way of an extension 8, which reaches over the free end of the spindle 3, the nut 4 is connected with a connecting rod 9 which, in turn, is guided in a sealed-off manner out of the housing 5 and is provided with an extension 10 with a smaller diameter. On the extension 10, a first disk 11 is movably guided which rests against a pressure sensor 12 which may be constructed, for example, in the manner of a piezoelectric element. By way of a signal line 13, this pressure sensor 12 is connected with a multiparameter controller 20 by way of which the rotational speed of the motor 1 is controlled.

On the extension 10, a sleeve 14 with an end disk 15 is also disposed in a displaceable manner, in which case a spring element in the form of a plastic ring 16 is arranged between the end disk 15 and the disk 11 resting against the pressure sensor 12, which plastic ring 16 is also penetrated by the extension 10. At the end facing away from the disk 15, the sleeve 14 is provided with a connection end 17 for the connection with the casting plunger which is not shown, the free end of the extension 10 being provided with a step 18 of a larger diameter, which holds the sleeve on the extension 10 and can also be used for a certain prestressing of the plastic ring 16. This step 18 is away from an inner end surface 19 of the sleeve 14 by a distance a. The operation of the pressing-in unit is started when the molten metal is to be pressed in a known manner from the crucible of a hot-chamber diecasting machine into the mold. In this case, the electric drive 1 is caused by way of the multiparameter controller 20 to rotate the spindle 3, which has the result that the nut 4 travels from the illustrated position along the spindle 3 in the downward direction and in the process also presses the connecting rod 9 in the downward direction, specifically at the speed required for the filling operation of the casting mold.

When the mold is filled, the rotary drive of the spindle 3 must be switched from the speed control to the torque control. In order to avoid that the casting plunger in this case, as a result of the mass-caused moment of inertia of the drive, continues to press onto the incompressible molten mass situated in the mold and, as a result, undesirable pressure peaks occur in the driving mechanism, which may lead to damage, the spring element 16 is provided which compresses and takes up the path which otherwise would have had to be additionally covered by the casting plunger.

In this case, the arrangement is such that the path still covered by the drive is shorter than the measurement a. The spring element 16 therefore compresses by an amount slightly smaller than a and is tensioned. In this case, the arrangement may be designed such that the reaction force then exercised by the spring element 16 upon the sleeve 14 and the casting plunger is sufficiently high for causing in the molten mass the required afterpressure on the basis of a force, for example, in the order of from 7 to 8 tons (70 to 80 kilo N).

Figure 2:
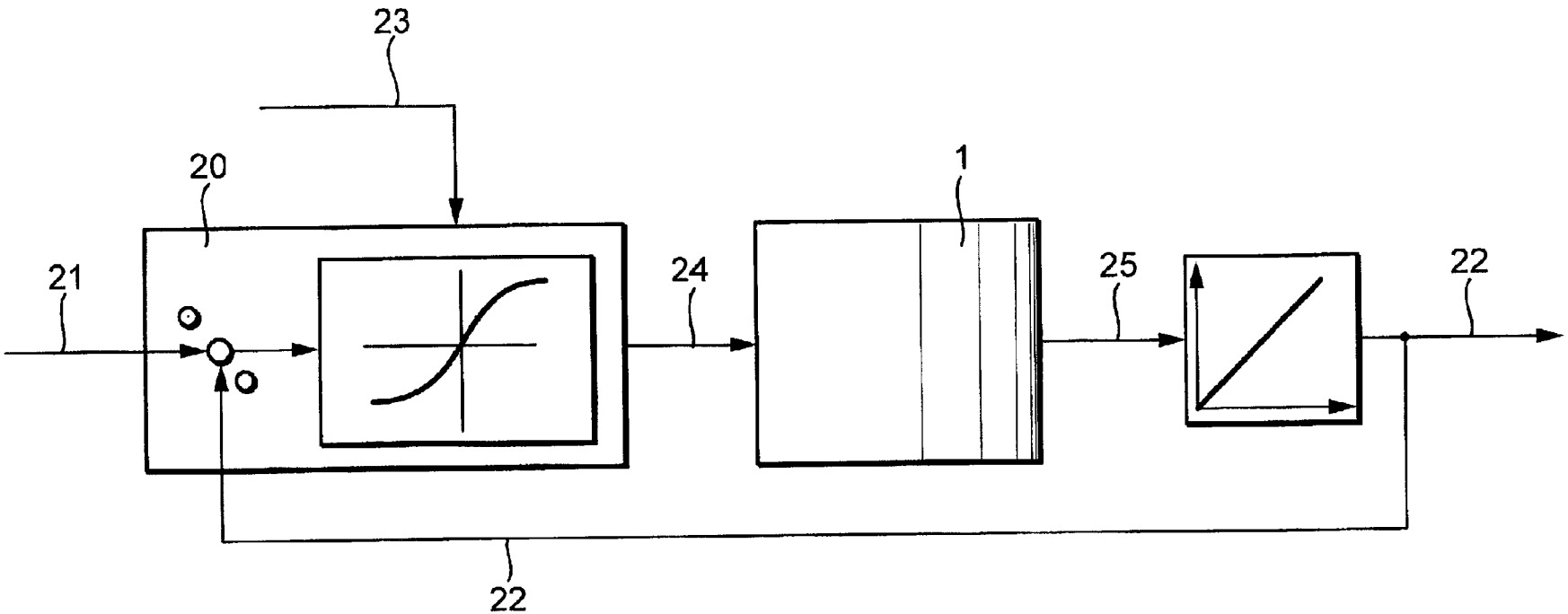
FIG. 2 is a schematic block diagram of a portion of the control units for the system of FIG. 1.

FIG. 2 illustrates that, for controlling the rotational speed and the torque of the electric motor 1, the desired position 21 for the casting plunger is supplied to the controller 20, which desired position 21 is compared with the actual position 22 which is taken at the output of the drive. The desired speed and the desired torque 23 are also supplied to the controller 20. The resulting desired rotational speed 24 is supplied to a digital or analog rotational speed and torque control, which is not shown in detail, for the motor 1, and in a known manner, the actual rotational speed 25 and the actual torque then leads to the feeding of the molten material (filling operation), for example, in the three known mold filling phases. When an actual position 22 is reached, at which the mold is filled, a switch-over to the torque control takes place in the manner described above and here, at the point in time at which the casting plunger velocity has reached a defined deceleration value, a vibration is superimposed on the torque.

Figure 3:
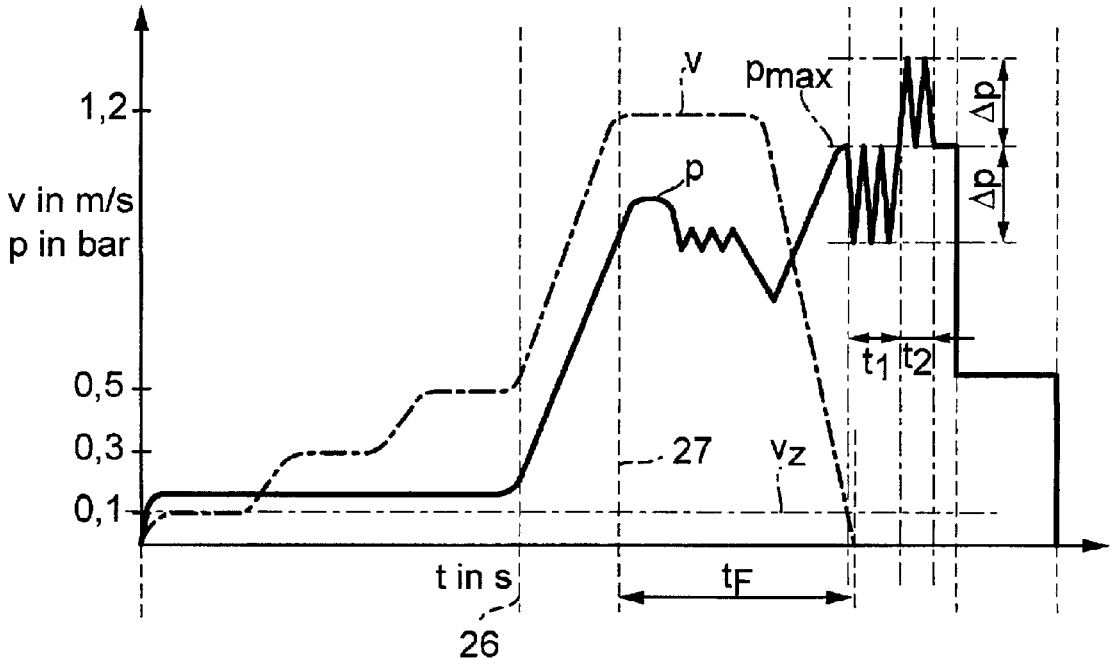
FIG. 3 is a representation of the course of the pressure and volume of the pressing-in operation according to the method of preferred embodiments of the invention.

FIG. 3 shows the details of this pressing-in operation. In FIG. 3, the mold filling time is entered on the abscissa and the plunger velocity as well as the pressure p generated in the molten mass by the forward-moving casting plunger are entered on the ordinate. FIG. 3 illustrates that, in a first time segment characterized as reaching to the line 26, the filling phase takes place at first at three - or more - different speeds, in which case then, at the point in time indicated between line 26 and line 27, a considerable rise of the plunger and filling velocity takes place. Starting from the point in time at Line 27, the filling operation of the mold takes place for the time period $t_F$. This filling operation therefore takes place at a high speed, in which case the pressure p also necessarily rises correspondingly in order to, shortly before its final rise, when the mold is filled, when the plunger velocity v returns to zero, rise one more time to the final pressure.

FIG. 3 now shows that, when a certain defined deceleration value $V_Z$ of 0.1 m per second of the plunger and filling velocity (which drops from the value of approximately 1.2 m per second) has been reached, a vibration is superimposed on the pressure exercised by the pressing-in unit (FIG. 1) such during a first time period $t_1$ that a pressure is created which pulsates about the value Δp and whose maximal value is at the final pressure reached first. In contrast, during a second time segment $t_2$, the pressure is increased by a value Δp with respect to the original final pressure but remains exposed to the triggered vibration.

Also mentioned initially, this measure has the result that, when the mold is filled, pressure fluctuations occur during the time segments $t_1$ and $t_2$ in the feed orifice between the mold cavity and the mouthpiece of the hot-chamber diecasting machine but also in the entire space taken up by the molten mass. This leads to the condition that, also in the most narrow cross-section of the feed orifice, which occurs in the gate, a pulsating pressure occurs at this point in time which prevents that the molten mass solidifies here prematurely and therefore closes off the connection to the mold cavity. The pressure increase taking place during the time period $t_2$ can therefore still have an effect on the entire mold cavity and on the molten mass situated there. At this point in time, the molten mass is in the so-called semisolid phase and, as a result of the invention, it becomes possible to achieve the maximum densification here. In this phase, no more burr will form on the outer contour of the diecast part in the mold. As a result of the vibrations about the value Δp, the pressure exercised as a sort of hammering by the casting plunger on the molten mass is transmitted to the metal situated in the mold which, as a result, can be densified more than otherwise customary in the case of the hot-chamber diecasting method. It was found that, by means of the new method, diecast parts can be obtained whose density, stability and porosity correspond to those which could otherwise be produced only by the cold-chamber diecasting method.

The method according to the invention was explained by means of an embodiment in which the pressing-in unit is operated by way of an electric servo motor. In the case of such servo-controlled machines, it is possible to define a braking point at the end of the filling operation. As a result, the occurrence of pressure peaks can be avoided which - as mentioned initially - would otherwise occur at the end of an unbraked filling operation. The filling speed is therefore reduced before the end of the filling of the mold so that parts without any burr can be produced as a result of this measure. This braking point, at which a defined deceleration is therefore present, may be considered as the starting point for the compressional vibrations.

However, it is definitely also contemplated by other preferred embodiments of the invention that, in the case of hot-chamber diecasting machines with a casting plunger which is acted upon hydraulically, after the filling of the mold, the hydraulic system is subjected to corresponding pressure fluctuations so that the invention can be implemented by means of such pressing-in units. It is finally also contemplated by other preferred embodiments of the invention that the vibrations are excited in a targeted manner by way of separate devices in the feed orifice and in the gate in the decisive phase after the filling of the mold, in order to then also prevent the so-called "freezing" of the molten mass in the feed orifice. A pulsating pressurization by way of the casting plunger would then not be required.

However, the illustrated application of the new casting method in the case of a pressing-in unit with a casting plunger driven by an electric motor can be implemented very easily because it is sufficient to provide corresponding software for the control by way of an electronic computer which will then, at the point in time explained by means of FIG. 3, initiate the desired vibrations when a switch-over takes place to the torque control.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed:

1. Hot-chamber diecasting machine for implementing a method by which molten metal is pressed from a casting vessel by way of an ascending bore, a mouthpiece, and a feed orifice into a mold, said diecasting machine comprising:

a casting plunger drive, and a control device for the casting plunger drive, wherein a pulsation device is assigned to the casting plunger drive and is connectable in a final phase of the filling operation and whose vibrations act upon a drive shaft of a casting plunger, and wherein, prior to completion of mold filling, at least in a narrowest cross-section of a feed orifice, a compressional vibration which prevents the molten metal from rapidly solidifying is initiated.

2. Hot-chamber diecasting machine according to claim 1, having an electric-motor-driven casting plunger, wherein the pulsation device comprises an electric servo drive and the control device controls the electric servo drive.

3. Hot-chamber diecasting machine according to claim 2, wherein the control device is an electronic computer in the form of a multiparameter controller which is operated by correspondingly designed software.

4. Hot-chamber diecasting machine according to claim 3, wherein said mold filling operation has a duration of 7 to 20 milliseconds.

5. Hot-chamber diecasting machine according to claim 2, wherein the servo drive is a brushless electric motor with a low flywheel effect.

6. Hot-chamber diecasting machine according to claim 2, wherein said mold filling operation has a duration of 7 to 20 milliseconds.

7. Hot-chamber diecasting machine according to claim 1, wherein said mold filling operation has a duration of 7 to 20 milliseconds.

8. Hot-chamber diecasting machine according to claim 1, wherein the compressional vibration which prevents the molten metal from rapidly solidifying is initiated prior to completion of mold filling when a velocity of the casting plunger decreases below a predetermined value.

9. Hot-chamber diecasting machine according to claim 1, wherein the compressional vibration is increased over time as the molten metal solidifies.

10. Hot-chamber diecasting machine according to claim 8, wherein the compressional vibration is increased over time as the molten metal solidifies.

11. A method of making a die cast part in a hot-chamber diecasting machine, comprising:

pressing molten metal from a casting vessel into a mold by way of an ascending bore, a mouthpiece, and a feed orifice, and generating, prior to completion of mold filling, a compressional vibration at a cross-section of the feed orifice during said pressing at an end portion of a mold filling operation to thereby prevent rapid solidification of said molten metal in said feed orifice.

12. A method according to claim 11, wherein said pressing is carried out using a casting plunger which is moved against the molten metal in predetermined mold filling phases, and wherein said generation of a compressional vibration includes acting on said casting plunger with a pulsating pressure.

13. A method according to claim 12, wherein said casting plunger is driven by an electric motor drive and wherein said pulsating pressure is generating by superimposing a vibration on the electric motor drive.

14. A method according to claim 13, wherein the vibration takes place at approximately 300 Hz and is initiated with a defined deceleration of a casting plunger velocity.

15. A method according to claim 14, wherein said mold filling operation has a duration of 7 to 20 milliseconds.

16. A method according to claim 13, wherein said mold filling operation has a duration of 7 to 20 milliseconds.

17. A method according to claim 12, wherein the pressure is decreased or increased in a pulsating manner with respect to a maximal casting pressure.

18. A method according to claim 17, wherein the pressure is decreased or increased in a pulsating manner with respect to the maximal casting pressure.

19. A method according to claim 12, wherein said mold filling operation has a duration of 7 to 20 milliseconds.

20. A method according to claim 11, wherein said mold filling operation has a duration of 7 to 20 milliseconds.

21. A method according to claim 11, wherein the compressional vibration which prevents the molten metal from rapidly solidifying is initiated prior to completion of mold filling when a velocity of the casting plunger decreases below a predetermined value.

22. A method according to claim 21, wherein the compressional vibration is increased over time as the molten metal solidifies.

23. A method according to claim 11, wherein the compressional vibration is increased over time as the molten metal solidifies.

24. A hot-chamber diecasting machine comprising:

means for pressing molten metal from a casting vessel into a mold by way of an ascending bore, a mouthpiece, and a feed orifice, and means for generating, prior to completion of mold filling, a compressional vibration at a cross-section of the feed orifice during said pressing at an end portion of a mold filling operation to thereby prevent rapid solidification of said molten metal in said feed orifice.

25. A hot-chamber diecasting machine according to claim 24, wherein said means for pressing includes a casting plunger which is moved against the molten metal in predetermined mold filling phases, and wherein said means for generating a compressional vibration includes means for acting on said casting plunger with a pulsating pressure.

26. A hot-chamber diecasting machine according to claim 25, wherein said casting plunger is driven by an electric motor drive, and wherein said means for generating a compressional vibration includes means for superimposing a vibration on the drive.

27. A hot-chamber diecasting machine according to claim 26, wherein the vibration takes place at approximately 300 Hz and is initiated with a defined deceleration of a casting plunger velocity.

28. A hot-chamber diecasting machine according to claim 27, wherein said mold filling operation has a duration of 7 to 20 milliseconds.

29. A hot-chamber diecasting machine according to claim 26, wherein the pressure is decreased or increased in a pulsating manner with respect to a maximal casting pressure.

30. A hot-chamber diecasting machine according to claim 29, wherein the pressure in a final phase is decreased during a first brief time period and is increased during a second time period before a complete solidification of the molten mass occurs.

31. A hot-chamber diecasting machine according to claim 25, wherein said mold filling operation has a duration of 7 to 20 milliseconds.

32. A hot-chamber diecasting machine according to claim 26, wherein said mold filling operation has a duration of 7 to 20 milliseconds.

33. A hot-chamber diecasting machine according to claim 24, wherein said mold filling operation has a duration of 7 to 20 milliseconds.

34. A hot-chamber diecasting machine according to claim 24, wherein the compressional vibration which prevents the molten metal from rapidly solidifying is initiated prior to completion of mold filling when a velocity of the casting plunger decreases below a predetermined value.

35. A hot-chamber diecasting machine according to claim 34, wherein the compressional vibration is increased over time as the molten metal solidifies.

36. A hot-chamber diecasting machine according to claim 24, wherein the compressional vibration is increased over time as the molten metal solidifies.

* * * * *